United States Patent [19]

Neumann

[11] 4,322,929

[45] Apr. 6, 1982

[54] PACKAGING METHOD USING AN ADHESIVE COATED WEB

[75] Inventor: Robert G. Neumann, Dayton, Ohio

[73] Assignee: The Specialty Papers Company, Dayton, Ohio

[21] Appl. No.: 129,764

[22] Filed: Mar. 12, 1980

[51] Int. Cl.[3] ..... B65B 9/08

[52] U.S. Cl. ..... 53/451; 53/551; 428/35

[58] Field of Search ..... 53/450, 451, 411, 170, 53/172, 550, 551, 552, 553, 554; 428/35, 157, 172, 200; 156/218, 157; 493/264, 276, 331, 336, 337

[56] References Cited

U.S. PATENT DOCUMENTS

| | | | |
|---|---|---|---|
| 2,132,931 | 10/1938 | Bohn | 91/67.9 |
| 2,169,936 | 8/1939 | Wagner | 156/218 X |
| 2,185,470 | 1/1940 | MacDonald et al. | 229/87 |
| 2,347,439 | 4/1944 | Shea et al. | 53/455 |
| 2,403,995 | 7/1946 | Peters | 156/218 |
| 2,899,875 | 8/1959 | Leasure | 53/551 X |
| 3,540,959 | 11/1970 | Connor | 156/218 X |
| 3,654,061 | 4/1972 | Berwanger | 428/192 X |
| 3,661,322 | 5/1972 | Norman | 53/554 X |
| 3,770,556 | 11/1973 | Evans et al. | 156/218 X |
| 3,788,876 | 1/1974 | Baker et al. | 117/38 |
| 3,806,389 | 4/1974 | Gwynne | 428/192 X |
| 4,122,222 | 10/1978 | Parker | 428/172 X |

*Primary Examiner*—Horace M. Culver

*Attorney, Agent, or Firm*—Biebel, French & Nauman

[57] ABSTRACT

A method, apparatus and material for continuously forming and filling packages is disclosed. A web of packaging material is coated on one side with a hot melt adhesive while allowing a longitudinal strip adjacent to the edge of the web to remain uncoated. The web thus coated is drawn over a forming shoe which shapes the web into a tube whose interior surface is the coated side of the web, and in which the edges of the web overlap to form a seam such that the uncoated longitudinal strip is the inner overlapped edge. The longitudinal seam is sealed by the coaction of a heated shoe or collar located externally of the tube and a tonque positioned within the tube adjacent the uncoated longitudinal strip. The longitudinal seam is sealed continuously without the accumulation of hot melt adhesive on the tongue. After the longitudinal seam is sealed, the tube is sealed laterally at spaced portions by the coaction of a pair of heated dies.

2 Claims, 4 Drawing Figures

PACKAGING METHOD USING AN ADHESIVE COATED WEB

BACKGROUND OF THE INVENTION

1. Field of the Invention

The present invention relates to a method, apparatus and material for forming packages and more particularly to a method, apparatus and material for continuously forming packages from strip packaging film by passing the film over a forming shoe.

2. Prior Art

Devices are presently used which form packages from strip packaging film and at the same time fill the packages with product. For example, U.S. Pat. No. 2,899,875 discloses a method and apparatus in which a strip of packaging film is drawn over a forming shoe which shapes the film into a tube in which the edges of the film overlap to form a seam. Both edges of the film are coated with a heat sealing compound and are joined as the seam of the tube is drawn between a heated shoe and a tongue.

In later versions of this apparatus, one side of the film (which is to become the inner surface of the package) is completely coated with a hot melt coating which also serves as a package liner to protect the contents from moisture. This improvement facilitates the joining of the edges of the film to form the longitudinal seam and permits the tube itself to be laterally sealed at spaced intervals by the coaction of a pair of heated dies.

However, these later versions possess a disadvantage in that the hot melt coating on the film accumulates on the tongue during successive seam sealing operations resulting in lumpy seams and frequent shut downs of the apparatus to clean the tongue.

Accordingly, the need exists for a system which avoids the problems of coating accumulation on the tongue and yet provides the advantages of the completely coated films presently in use.

SUMMARY OF THE INVENTION

The present invention provides an improved method, apparatus and material for continuously forming packages in which hot melt coating accumulation on the tongue is totally eliminated thereby improving the quality of the sealed package and reducing maintenance costs by extending running time between shut downs. Thus, the desirable vapor and moisture barrier characteristics of the hot melt coating can be retained without the undesirable contamination of the equipment. This benefit is achieved by utilizing a strip packaging film, also known as a web, in which the side of the web coated with a hot melt coating has an uncoated longitudinal strip adjacent an edge. As the web is drawn over the forming shoe and shaped into a tube in which the edges overlap to form a longitudinal seam, the inner overlapped edge carries the uncoated strip.

Thus, at no time during any step of the process does a heat sealing means contact a surface of the web which is coated with hot melt coating. With regard to the longitudinal seam sealing step of the process, the uncoated strip on the inner overlapped edge contacts the tongue and the heated shoe contacts the uncoated side of the outer overlapped edge of the web. With regard to the lateral tube sealing step of the process, a pair of heated dies contact the outer uncoated surface of the tube at laterally spaced portions and seal the tube utilizing the hot melt coating which coats the inner surface of the tube.

The quality of the longitudinal seam is enhanced by tapering the thickness of that portion of the hot melt coating which is deposited adjacent the uncoated longitudinal strip.

DETAILED DESCRIPTION OF THE PREFERRED EMBODIMENT

Figure 1:
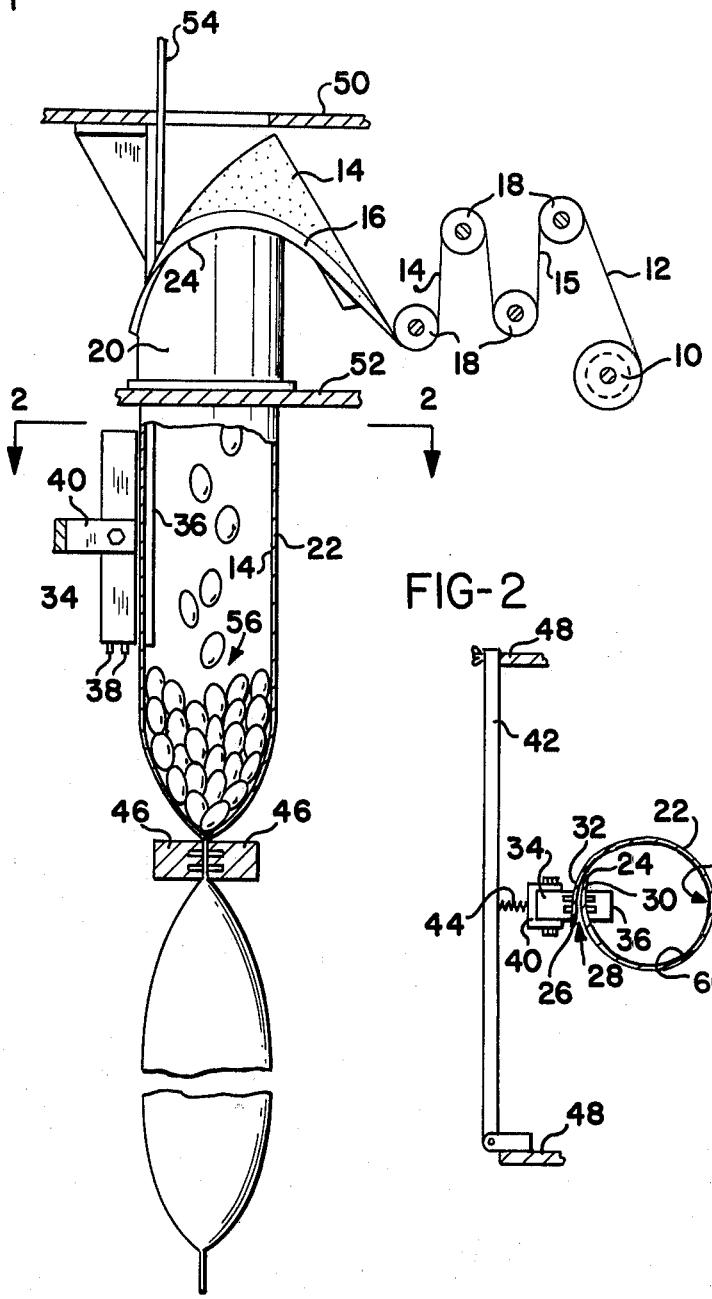
FIG. 1 is a side elevation in partial cross section of a preferred embodiment of the present invention.

As shown in FIG. 1, the packaging apparatus includes a drum 10 of packaging web material. The web 12 is fabricated of packaging material suitable for optimum machinability on form and fill packaging equipment. The web 12 has a coated side 14 on which a hot melt coating has been deposited so as to form an uncoated longitudinal strip 16. On the other side 15 is placed the printing and decoration as well as a lacquer overcoat, such as nitrocellulose, having good slip characteristics. The web 12 is threaded through a series of rollers 18 which maintain proper tensioning of the web 12 in a manner known in the art. The web 12 next engages and passes through a forming shoe 20 which shapes the web into a tube 22.

Figure 2:
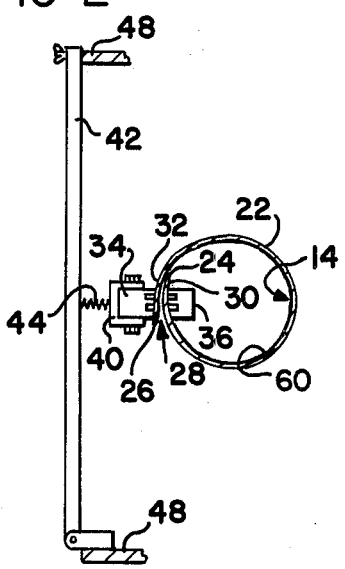
FIG. 2 is a top plan view of a cross section of the embodiment taken along line 2—2 of FIG. 1.

As shown in FIGS. 1 and 2, the longitudinal edges 24, 26 of the web 12 overlap to form a longitudinal seam 28 having an inner overlapped edge 30 comprising the uncoated longitudinal strip 16 and an outer overlapped edge 32. The longitudinal seam 28 passes in between a heated shoe 34 and a tongue 36 such that the heated shoe is adjacent the outer overlapped edge 32 and the tongue is adjacent the inner overlapped edge 30. The heated shoe 34 is powered by electric resistance heat and is connected to a power source (not shown) by electrical leads 38. The heated shoe 34 is held by a clevis 40 which is attached to a hinged arm 42 by a resilient means 44.

As shown in FIG. 1, a pair of heated dies 46 is positioned below the heated shoe 34 and tongue 36 on either side of the tube 22. The heated dies 46 are part of an advancing means (not shown) known in the art for engaging and laterally heat sealing a portion of the tube 22 below the heated shoe 34 and tongue 36, drawing the tube downward, disengaging the tube, then reciprocating upward to engage and seal the tube again at a spaced interval from the first lateral seal, thus forming the completed package.

Figure 3:
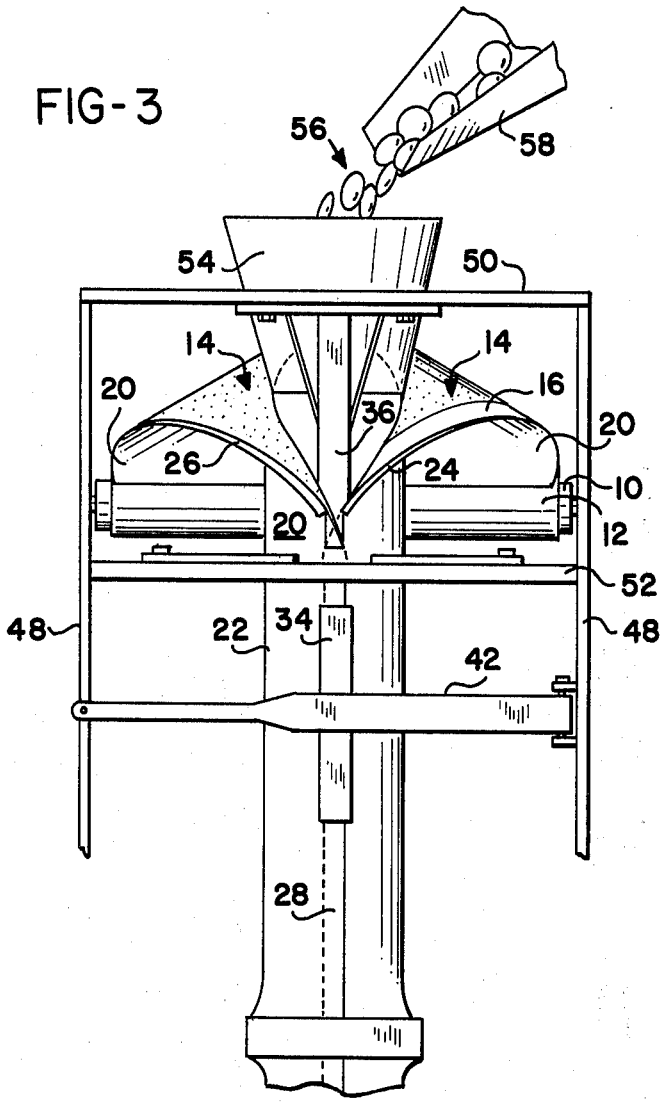
FIG. 3 is a front elevational view of the embodiment of FIG. 1.

As shown in FIG. 3, the aforementioned apparatus is supported by a frame 48 having a top panel 50 and an intermediate panel 52. The top panel 50 supports the tongue 36, which extends through the tube 22, and a baffle plate 54 which directs the flow of the product 56 from a loading means 58. The intermediate panel 52 supports the forming shoe 20 and is adjustable to accommodate varying positions of the rollers 18. The hinged arm 42 is mounted on the frame 48 below the intermediate panel 52 and can be pivoted away from the frame to facilitate maintenance of the heated shoe 34 and tongue 36.

Figure 4:
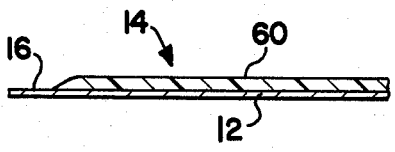
FIG. 4 is a cross section of the web of packaging material of the present invention.

As shown in FIG. 4, it is preferable to taper the thickness of the hot melt coating 60 on the coated side 14 of the web 12 in an area immediately adjacent the uncoated longitudinal strip 16. Tests have shown that a more uniform seal and machine performance is effected if the hot melt coating 60 is tapered in this fashion. That is, a sharp edge at the stopping point of the hot melt coating will lead to formation of ridges along longitudinal seam 28. By use of a taper, as shown in FIG. 4, this is prevented. The uncoated longitudinal strip is formed by placing an obstruction in the slot orifice die used to lay down the hold melt coating.

Referring to the method of operation of the present invention, the web 12 is drawn over and through the forming shoe 20 by the reciprocating action of the heated dies 46 of the advancing means thereby shaping the web into a tube 22 whose inner surface is the coated side 14 of the web. After the tube 22 is formed and leaves the forming shoe 20, the unsealed longitudinal seam 28 engages the heated shoe 34 and tongue 36. The heated shoe 34 is urged against the tongue 36 by the resilent means 44 thereby compressing the outer overlapping edge 32 against the inner overlapping edge 30. The longitudinal seam 28 is heated thereby activating the hot melt coating on the coated side 14 of the web 12 and the seam is sealed. Since the heated shoe 34 contacts the outer uncoated surface of the tube 22 and the tongue 36 contacts the uncoated longitudinal strip 16 of the coated side 14, neither element touches the hot melt coating and thus the problem of coating build up on these elements is eliminated.

After the longitudinal seam 28 is sealed, the tube 22 engages the heated dies 46 which compress, heat, and laterally seal the tube. Since the entire inner surface of the tube 22 is coated with hot melt coating, save for the uncoated longitudinal strip 16, an effective seal of the tube can be achieved at any point along the tube thereby eliminating the need for precise positioning of the heated dies 46 with respect to the tube.

The hot melt coating also serves as a moisture barrier coat for the package. It is preferably a mixture of waxes, copolymers and tackifiers. The preferred wax mixture is a combination of a paraffin based wax (such as R 3663 from Moore & Munger, Inc., Fairfield, Conn.) and an inter polymer of ethylene, vinyl acetate and organic acid material (such as Elvax 4260 from E. I. Du Pont de Nemours Co.). To this there is added a tackifier (such as Piccotex LC from Pennsylvania Industrial Chemical Corp., Clairton, Pa.). The hot melt material is coated onto the paper at the rate of 4–8 lbs/ream (3,000 sq. ft.). Other hot melt coatings such as high melting point microcystallene waxes and ethylene-vinyl acetate copolymers and mixtures of the two counts also are used.

After the tube 22 is laterally sealed at what thus becomes the bottom edge of the next individual package, the product 56 is deposited in the sealed tube from the loading means 58 through the forming shoe 20. Next, the heated dies 46 draw the sealed tube 22 downward thereby drawing the web 12 over the forming shoe 20 to repeat the process. The portion of the tube 22 laterally sealed by the heated dies 46 serves at both the bottom seal of one package and the top seal of the immediately preceding package. As such it can be cut thereby separating sealed packages from the tube by means well known in the art.

While the form of apparatus herein described constitutes a preferred embodiment of this invention, it is to be understood that the invention is not limited to this precise form of apparatus, and that changes may be made therein without departing from the scope of the invention.

What is claimed is:

1. In a method of continuously forming and filling packages of the type wherein an advancing web having opposing longitudinal edges is shaped into a tube in which the longitudinal edges overlap to form a longitudinal seam, the longitudinal seam is passed in between a shoe located externally of the tube and a tongue positioned internally of the tube proximate the longitudinal seam, and the longitudinal seam is sealed by heating the shoe and urging the shoe toward the tongue, a portion of the tube is compressed and heated by a pair of opposing dies whereby the tube is laterally sealed, and portions of the tube are filled with a product between the lateral seals, the improvement comprising:

utilizing a web having a side of the web coated with a hot melt coating compound such that a longitudinal strip adjacent a longitudinal edge remains uncoated whereby the longitudinal strip forms an inner inside-facing overlapped edge of the seam and abuts the tongue as the seam is laterally sealed so that the tongue remains free from accumulations of hot melt coating.

2. The method of claim 1 wherein the thickness of a portion of the hot melt coating coated on said web adjacent the uncoated longitudinal strip tapers toward the uncoated longitudinal strip.

* * * * *